United States Patent [19]

Pope

[11] Patent Number: 4,894,029

[45] Date of Patent: Jan. 16, 1990

[54] CONTACT FOR METALLIZED FILM

[75] Inventor: Richard A. Pope, Austin, Tex.

[73] Assignee: Minnesota Mining and Manufacturing Company, St. Paul, Minn.

[21] Appl. No.: 325,154

[22] Filed: Mar. 17, 1989

[51] Int. Cl.[4] ..... H01R 13/00

[52] U.S. Cl. ..... 439/816; 439/883

[58] Field of Search ..... 439/92, 96, 801, 816, 439/883

[56] References Cited

U.S. PATENT DOCUMENTS

| | | | |
|---|---|---|---|
| 830,913 | 9/1906 | Mundshenk . | |
| T861,012 | 4/1969 | Mendola | 439/801 |
| 876,515 | 1/1908 | Barnes | 439/883 |
| 1,279,192 | 9/1918 | Wheeler . | |
| 1,697,954 | 1/1929 | Gribbie | 439/883 |
| 1,845,273 | 2/1932 | Hosking | 439/883 |
| 2,679,569 | 8/1951 | Hall | 201/73 |
| 2,992,403 | 4/1957 | Hawk | 339/213 |
| 3,093,005 | 9/1960 | Dean | 74/232 |
| 3,144,803 | 8/1964 | Briles | 439/801 |
| 3,423,721 | 11/1966 | Rushton | 339/174 |
| 3,553,033 | 8/1968 | Page | 136/132 |
| 3,900,241 | 8/1975 | Fry | 339/59 |
| 4,558,492 | 12/1985 | Hite et al. | 24/37 |
| 4,695,108 | 9/1987 | Ichitsubo | 439/59 |

*Primary Examiner*—Joseph H. McGlynn

*Attorney, Agent, or Firm*—Donald M. Sell; Walter N. Kirn; Jack V. Musgrove

[57] ABSTRACT

A contact for electrically connecting a wire or cable to a conductive surface, such as metallized film. The contact is essentially a circular disk having bias means integral with the disk whereby, as a depression plate is lowered over the disk, the depression plate contacts bias means, facilitating even contact between the disk and the metallized film. The bias means preferably takes the form of tines integral with the disk which have benn formed to be slightly skewed with respect to the upper surface of the disk. The tines may be replaced by stretched bands, a coil spring, or may be eliminated by the curving the disk to form a Belleville spring.

20 Claims, 3 Drawing Sheets

CONTACT FOR METALLIZED FILM

BACKGROUND OF THE INVENTION

1. Field of the Invention

The present invention generally relates to electrical contacts, and more particularly to a contact designed for making an electrical connection with a thin metallized film.

2. Description of the Prior Art

Metallized films are used for a wide variety of purposes in the electronics industry. They basically consist of a substrate film, often a dielectric, and a metal layer which is deposited on the film by one of several different methods, e.g., vapor deposition. The film may then be used as a common ground, or for electromagnetic shielding. More recently, such films have been utilized as "slot" antennas, which derive their name from the fact that a nonconductive slot separates two metallized areas on the film.

Obviously, some form of connector is necessary to electrically couple the film to the appurtenant circuitry. Several such connectors exist in the prior art, and the simplest of these is shown in FIG. 1. In that figure, the metallized film 10 contains an aperture through which a bolt 12 passes. The bolt is firmly attached to the film by means of two washers 14 and 16, a split ring washer 18, and a nut 20. A second nut 22 holds an eyelet 24 in place, which is connected to a wire 26. This construction is described in U.S. Pat. No. 2,679,569 issued to R. Hall.

A slightly more complicated version of a film connector is shown in FIG. 2. This implement utilizes a mechanical snap, including female snap 28 and male plug 30. One of these components, say female snap 28, is fastened to film 10, such as by a rivet 32 with an intermediate washer 34. Male plug 30 is attached to another rivet 36 and washer 38, rivet 36 further having a wire 40 connected (soldered) thereto. By simply snapping plug 30 into snap 28, an electrical connection between film 10 and wire 40 is achieved.

FIG. 3 illustrates a third type of film connector in which a tab member 42 having a plurality of teeth 44 is crimped against film 10. A rivet or bolt 46 holds tab member 42 in place, a washer 48 also serving as a backing plate for teeth 44. Finally, FIG. 4 depicts an even more simplistic version of a film connector in which a tab member 50 is connected to the film 10 by means of a transversely conductive (pressure-sensitive) adhesive 52.

The primary disadvantage of each of the foregoing connectors relates to the contact pressure, essential for a proper electrical connection. All of the illustrated prior art devices, except for the toothed tab member 42, are particularly susceptible to decreased contact pressure due to vibrations, stress relaxation of the bolt or rivet, and creep of the film. These conditions may eventually lead to practical failure of the connectors. Conversely, while it is unlikely that the connector shown in FIG. 3 would migrate with respect to the film, the existence of multiple perforations increases the likelihood of tearing the film during handling or servicing. This is particularly likely to occur considering the "notch sensitivity" of common film materials such as polyester.

Another problem with all four of the described prior art devices is the difficulty in visually verifying a proper contact termination. Finally, with respect to the design depicted in FIG. 4, the mechanical integrity of this connection is extremely limited by both the properties of the adhesive and the adhesion of the metal deposited on the film's surface. It would, therefore, be desirable and advantageous to devise a contact for metallized film which would maintain a proper contact pressure while minimizing the possibility of tearing the film material.

Accordingly, the primary object of the present invention is to provide an electrical contact for metallized film.

Another object of the invention is to provide such a contact which maintains a constant, even pressure against the film.

Still another object of the invention is to provide a contact for metallized film which inhibits tearing or rupturing of the film material.

Yet another object of the invention is to provide such a contact which promotes proper alignment of the contact parallel to the film.

SUMMARY OF THE INVENTION

The foregoing objects are achieved in a contact having spring or bias means integral with the contact. The bias means preferably take the form of a plurality of tines partially cut out of an essentially circular disk, the tines being slightly formed to protrude from the surface of the disk. The disk is fastened to the metallized film by a rivet, and the rivet also secures a depression plate against the side of the disk from which the tines protrude, and a backing plate on the side of the film opposite the disk. This insures uniform, parallel contact of the disk with the film surface.

BRIEF DESCRIPTION OF THE DRAWINGS

The novel features of the invention are set forth in the appended claims. The invention itself, however, will best be understood by reference to the accompanying drawings, wherein:

DESCRIPTION OF THE PREFERRED EMBODIMENT

Figure 5A:
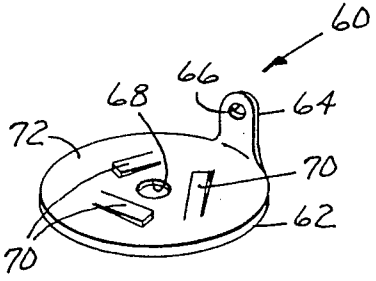
FIGS. 5A and 5B are perspective and bottom plan views, respectively, of the tine-cut disk embodiment of the present invention.
Figure 5B:
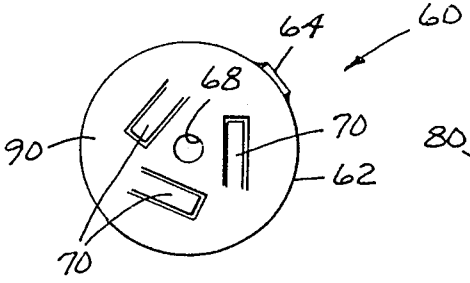

With reference now to the figures, and in particular with reference to FIGS. 5A and 5B, there is depicted a film contact 60. Contact 60 takes the form of an essentially flat, circular disk 62 having an integral tab portion 64. Tab 64 contains an aperture 66 for receiving a wire to complete the electrical connection between contact 60 and its appurtenant electrical components. Another opening 68 lies near the center of disk 62 for receiving the fastening means used to affix contact 60 to the metallized film.

A plurality of symmetrically spaced tabs or tines 70 have been cut from disk 62, and formed at an oblique angle so that the free ends project above the upper surface 72 of disk 62. It is understood that upper surface 72 of disk 62 is that surface from which tab 64 extends (although tab 64 is not necessarily disposed perpendicular to upper surface 72), and that tines 70 are bent so as to form bias means as will become apparent with further discussion of the invention.

Disk 62 may be any size or shape, but for most applications it is anticipated to be circular with a diameter of approximately two centimeters is sufficient. For space considerations, it is preferable that disk 62 be fairly thin, e.g., about one millimeter or less in thickness, but thicker disks may be used. In this regard, thicknesses of the various components of the present invention, as well as the thickness of the film, are somewhat exaggerated in the drawings for clarity. Although disk 62 need not be circular, this is preferred to avoid any sharp corners which might damage the underlying film.

There are two basic requirements concerning the material forming disk 62: first, the material (or a coating thereon) must be conductive; secondly, the material must be sufficiently rigid to provide a spring action or positive bias via tines 70. There are dozens of materials that meet these requirements, but the preferred material depends on the type of metal coating on film 74. For example, if metal coating 78 is copper, the preferred material would be a copper alloy, such as beryllium-copper. If metal coating 78 is aluminum, the preferred material for disk 62 would also be aluminum.

The above construction of contact 60 facilitates manufacture thereof. Disk 62 is stamped from a flat sheet of the appropriate material, tab portion 64 being integral with and parallel to the stamped disk. Holes 64 and 68 are cut out at the same time tines 70 are cut. In order to minimize potential tears in the film, the stamping/cutting direction should be from the film mating side to upper surface 72 so that any burrs will be in the direction away from the film. Tab portion 64 is then bent approximately perpendicular to disk 62, and the free ends of tines 70 are pushed slightly outward, resulting in the finished contact 60. These steps may be conveniently performed by automated equipment.

Figure 1:
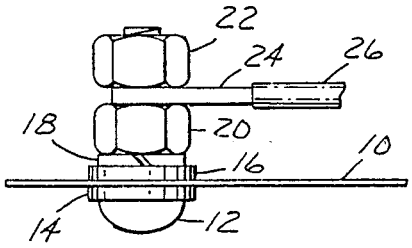
Fig. 1 PRIOR ART
FIG. 1 is a side elevational view of a prior art film connector having a bolt, nuts and washers.
Figure 2:
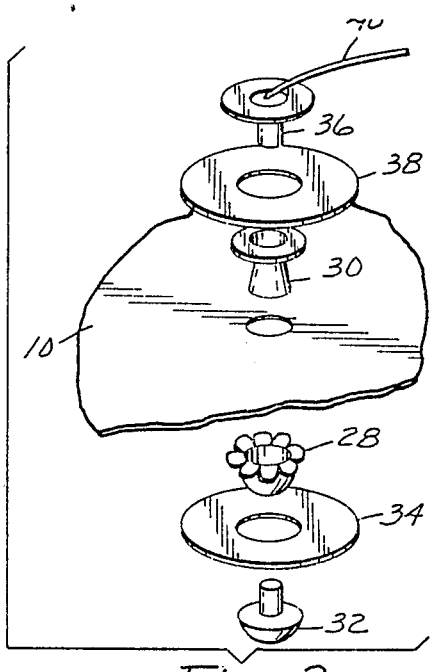
Fig. 2 PRIOR ART
FIG. 2 is an exploded perspective view of a prior art film connector utilizing snaps.
Figure 3:
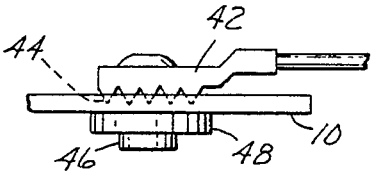
Fig. 3 PRIOR ART
FIG. 3 is a side elevational view of a prior art film connector having a toothed or spiked tab member.
Figure 4:
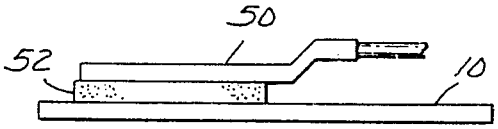
Fig. 4 PRIOR ART
FIG. 4 is a side elevational view of a prior art film connector employing an adhesive layer.
Figure 6A:
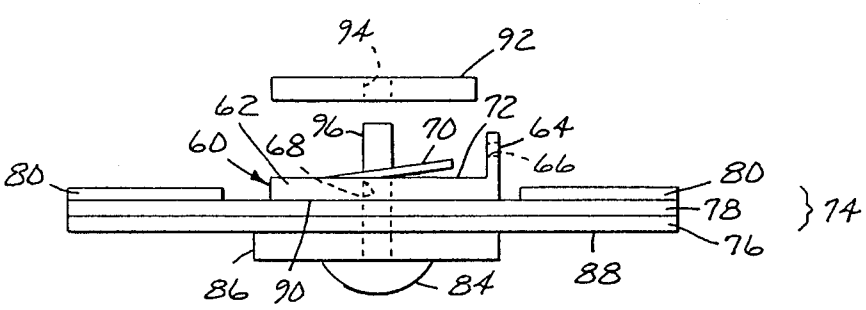
FIGS. 6A and 6B are side elevational views, with the metallized film depicted in cross-section, illustrating the fastening method and optional insulative means surrounding the contact of the present invention.
Figure 6B:
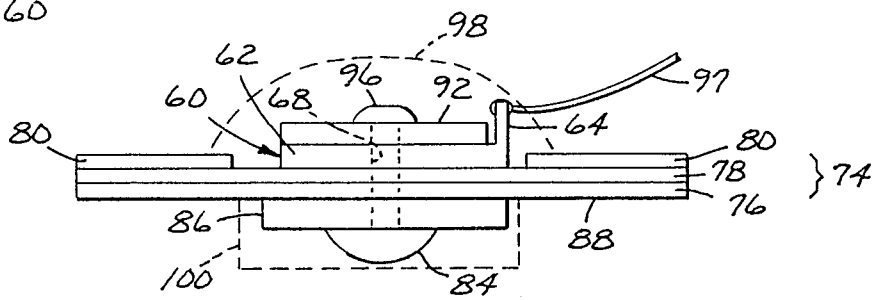
Figure 7:
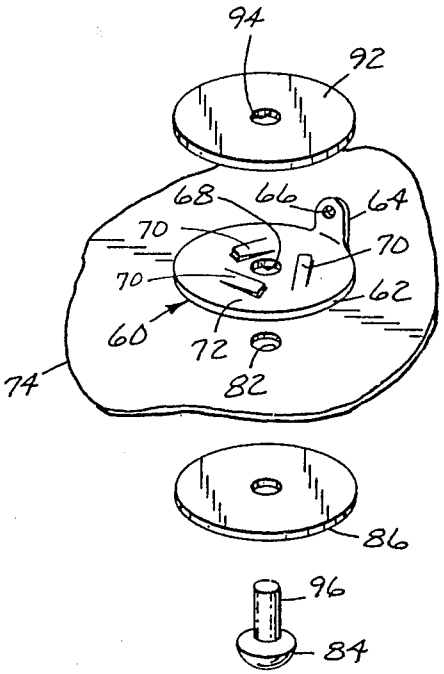
FIG. 7 is an exploded perspective view of FIG. 6A.

Referring now to FIGS. 6A, 6B and 7, the method of attaching contact 60 to a metallized film 74 is explained. Metallized film 74 typically includes three layers, substrate layer 76, metal coating 78, and insulative laminate 80. Substrate layer 76 may be any one of a number of materials, usually polymeric, such as vinyl, polyester, fluoroplastic, or cellulose. Metal coating 78 is applied by conventional methods such as vacuum vaporization, sputtering, lamination, or printcoating. Insulative laminate 80 may also be any one of a number of materials, such as a copolymer resin.

Before affixing contact 60 to film 74, film 74 must be prepared by removing a portion of insulative laminate 80 (an area slightly larger than disk 62) to allow electrical contact between metal coating 78 and disk 62, and a hole 82 punched therein for passage of the fastener. In the preferred embodiment, the fastener is a rivet 84 which passes through hole 82, securing a backing plate 86 to the lower surface 88 of substrate 76. Contact 60 is then lowered, rivet 84 mating with opening 68, until the lower surface 90 of disk 62 contacts metal coating 78.

At this point, lower surface 90 of disk 62 may not be perfectly aligned with film 74 due to manufacturing flaws in disk 62 or irregularities in the thickness of film 74. Proper alignment, however, is guaranteed as a depression plate 92 is lowered over contact 60. Depression plate 92 is essentially the same size and shape as disk 62, except it may have a slightly smaller diameter in order to clear tab 64. It also has an opening 94 for receiving rivet 84.

As depression plate 92 is lowered, it first contacts one or more of the tines 70, creating downward pressure, and forcing disk 62 flush with metal coating 78. The terminal end 96 of rivet 84 is then expanded to hold the various components snugly in place. In this manner, a reliable electrical and mechanical connection is achieved without any scraping action by contact 60. Moreover, even if vibrations or other stresses cause depression plate 92 to move slightly away from disk 62, contact with tines 70 remains, providing a spring or bias action which keeps lower surface 90 of disk 62 flush against metal coating 78. As those skilled in the art will appreciate, other equivalent structures may perform the function of depression plate 92, such as a boss or cam molded integrally with an insulative housing which protects contact 60 (see below).

After securing contact 60 to film 74, a wire 97 may be attached to contact 60 by any convenient means, such as insertion in aperture 66 of tab 64 followed by soldering, crimping, etc (this step may actually be performed anywhere in the assembly process). Of course, tab 64 may be replaced by other wire receiving means. Wire 97 leads to any related electrical equipment, and may take the form of a coaxial cable. It is also desirable to envelop contact 60, depression plate 92, and the surrounding area with an insulative coating 98 which precludes accidental short-circuiting by contact with adjacent conductive bodies. The size of insulative coating 98 is exaggerated in FIG. 6B. Alternatively, an insulative body or housing 100 may surround the structure. For clarity, insulative body 100 is shown surrounding only rivet 84 and backing plate 86, but it is understood that a complimentary body may surround the upper portion of the structure. The insulative body 100 may be affixed using several methods, such as an adhesive, or fasteners which penetrate film 74.

Figure 8:
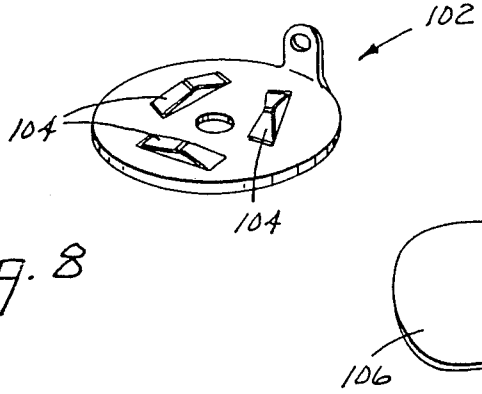
FIG. 8 is a perspective view showing an alternative contact disk of the present invention having integral stretched springs.

Another embodiment of the present invention is shown in FIG. 8. That figure illustrates a stretched-spring contact 102, which is essentially identical to contact 60, except that tines 70 have now been replaced with bands 104 which are integral with contact 102. Each band 104 is formed by making two parallel cuts, and then urging the resulting band upwards, as it stretches, to bulge slightly away from the upper surface of contact 102. This results in bands 104 having spring-like qualities, similar to a leaf spring. The foregoing discussion concerning use of a fastener, backing plate, and depression plate also applies to stretched-spring contact 102.

Figure 9:
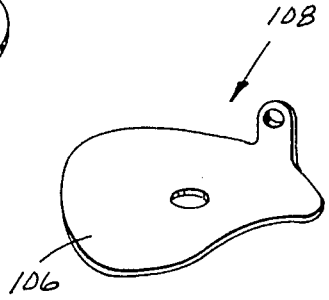
FIG. 9 is a perspective view depicting an alternative contact disk of the present invention forming a Belleville spring.
Figure 10:
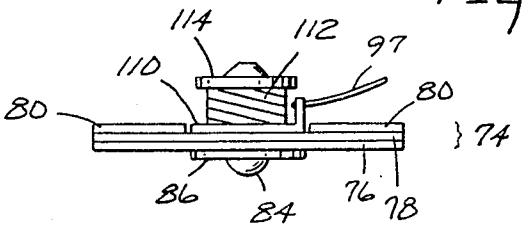
FIG. 10 is a side elevational view illustrating the opposing coil spring embodiment of the present invention.

With further reference to FIG. 9, a third embodiment of the present invention is explained. In this embodiment, no tines or bands are formed; rather, the entire disk 106 is curved so as to form a Belleville type spring, resulting in a Belleville contact 108. Belleville contact 108 utilizes fastening means, a backing plate, and a depression plate as described above in connection with contact 60. FIG. 10 discloses a fourth embodiment, Wherein the contact member 110 is essentially featureless, i.e., it has no tines or bands and further is flat, not curved, but a compression spring or coil 112 urges contact member 110 against film 74. The depression plate 114 may take the form of a retaining cap (not shown) which completely surrounds coil 112. Depression plate 114, coil 112 and contact member 110 are held in place by a rivet 84 or other fastening means.

It should be noted that the embodiments disclosed in FIGS. 8 and 10 are considered inferior to the other two embodiments (contacts 60 and 108) inasmuch as the contacts shown in FIGS. 8 and 10 do not provide as much initial deflection in the respective bias means. It has been found that tines 70 or Belleville contact 108 provide more deflection and, hence, more positive bias action which is desirable for maintaining proper contact with metal coating 78.

A film-to-film connection may be crafted by using two contacts 60 connected by a wire. Alternatively, if the two films overlap slightly, then a "sandwich" (not shown) may be formed by placing two contacts of the present invention between the two films (with tines from one contact touching the tines of the other), and securing the contacts with appropriate backing plates on the outside surfaces (substrate layers) of each film. In such a case, tab portion 64 would be unnecessary and should be absent from the contacts.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, a pair of contacts embodying the present invention may be utilized for connection of a slot antenna to related amplifying circuitry. It is therefore contemplated that the appended claims will cover such modifications that fall within the true scope of the invention.

I claim:

1. An article for electrically connecting a metallized film to a conductor, comprising:

a contact member having upper and lower surfaces, said contact member being constructed of an electrically conductive material;

means for fastening said contact member to the metallized film; and bias means for urging said lower surface of said contact member against the metallized film.

2. The article of claim 1 wherein said bias means is formed integrally with said contact member.

3. The article of claim 2 wherein said fastening means includes depression means for forcibly contacting said bias means.

4. The article of claim 3 wherein:

said depression means comprises a depression plate whose shape and size is approximately equal to that of said contact member, said depression plate being adjacent to said upper surface of said contact member; and said fastening means further includes a backing plate disposed opposite said depression plate, with respect to said contact member, for bracing the metallized film against said lower surface of said contact member.

5. The article of claim 4 wherein said contact member has means for receiving the conductor to be connected to the metallized film.

6. The article of claim 5 wherein said bias means comprises a plurality of tines formed from said contact member, said tines protruding from said upper surface of said contact member at an oblique angle whereby, as said depression plate is positioned adjacent said upper surface of said contact member, said depression plate forcibly contacts said tines, facilitating even contact of said lower surface of said contact member against the metallized film.

7. The article of claim 5 wherein said bias means comprises a plurality of bands formed from said contact member, said bands being stretched to bulge outward from said upper surface of said contact member whereby, as said depression plate is positioned adjacent said upper surface of said contact member, said depression plate forcibly contacts said bands, facilitating even contact of said lower surface of said contact member against the metallized film.

8. The article of claim 5 wherein said contact member is generally disk shaped and curved to form a Belleville contact, said bias means being inherent in said curvature of said Belleville contact whereby, as said depression plate is positioned adjacent said upper surface of said Belleville contact, said depression plate forcibly contacts said Belleville contact, facilitating even contact of said lower surface of said Belleville contact against the metallized film.

9. The article of claim 1 wherein said bias means comprises a coil spring adjacent said upper surface of said contact member.

10. A contact for electrically connecting a wire to a metal coating on a substrate, comprising:

a generally circular disk having upper and lower surfaces, said disk being constructed of an electrically conductive material, and said lower surface being generally planar;

a tab member attached to said disk, said tab member having an aperture therein for receiving the wire;

a depression plate whose size and shape is approximately equal to that of said disk, said depression plate being adjacent to said upper surface of said disk;

a backing plate disposed opposite said depression plate, with respect to said disk, for bracing the metal coated substrate against said lower surface of said disk;

bias means integral with said disk for urging said lower surface of said disk against the metal coating on the substrate; and means for fastening said disk, said depression plate, and said backing plate to the metal coated substrate.

11. The contact of claim 10 wherein said bias means comprises a plurality of tines formed from said disk, said tines protruding from said upper surface of said disk at an oblique angle whereby, as said depression plate is positioned adjacent said upper surface of said disk, said depression plate forcibly contacts said tines, facilitating even contact of said lower surface of said disk against the metal coating on the substrate.

12. The contact of claim 10 wherein said bias means comprises a plurality of bands formed from said disk, said bands being stretched to bulge outward from said upper surface of said disk whereby, as said depression plate is positioned adjacent said upper surface of said disk, said depression plate forcibly contacts said bands, facilitating even contact of said lower surface of said disk against the metal coating on the substrate.

13. The contact of claim 10 wherein said disk is curved to form a Belleville spring, said bias means being inherent in said curvature of said disk whereby, as said depression plate is positioned adjacent said upper surface of said disk, said depression plate forcibly contacts said Belleville spring, facilitating even contact of said lower surface of said disk against the metal coating on the substrate.

14. The contact of claim 10 wherein said disk, said depression plate, and said backing plate each contain openings for receiving said fastening means.

15. A contact plate for electrically connecting a wire to a conductive surface, comprising:

a generally circular disk having upper and lower surfaces, said disk being constructed of an electrically conductive material, and having an opening therein for receiving a fastener;

a tab member attached to said disk, said tab member having an aperture therein for receiving the wire; and bias means integral with said disk for urging said lower surface of said disk against the conductive surface.

16. The contact plate of claim 1 wherein said bias means comprises a plurality of tines formed from said disk, said tines protruding from said upper surface of said disk at an oblique angle.

17. The contact plate of claim 15 wherein said bias means comprises a plurality of bands formed from said disk, said bands being stretched to bulge outward from said upper surface of said disk.

18. The contact plate of claim 15 wherein said disk is curved to form a Belleville spring, said bias means being inherent in said curvature of said disk.

19. A method of connecting a wire to a film having a substrate layer, a metal coating, and an insulative laminate, comprising the steps of:

obtaining a contact plate comprising:

a generally circular disk having upper and lower surfaces, said disk being constructed of an electrically conductive material and having an opening therein, a tab member attached to said disk, said tab member having an aperture therein for receiving the wire, and bias means integral with said disk for urging said lower surface of said disk against the metal coating;

removing the insulative laminate from the metal coating in an area slightly larger than said contact plate;

placing said lower surface of said disk adjacent the metal coating where the insulative laminate has been removed;

positioning a backing plate adjacent the substrate layer, thereby securing the film between said backing plate and said disk, said backing plate having an opening therein;

passing a fastener through said opening in said backing plate, through said film, and through said opening in said disk;

lowering a depression plate over said upper surface of said disk whereby said depression plate forcibly contacts said bias means, facilitating even contact of said lower surface of said disk against the metal coating on the substrate layer; and securing said fastener.

20. The method of claim 19 further comprising the final step of electrically insulating said fastener, said depression plate, said contact plate, and said backing plate.

* * * * *

UNITED STATES PATENT AND TRADEMARK OFFICE

CERTIFICATE OF CORRECTION

PATENT NO. : 4,894,029

DATED : January 16, 1990

INVENTOR(S) : Richard A. Pope

It is certified that error appears in the above-identified patent and that said Letters Patent is hereby corrected as shown below:

Abstract - line 8, correct "benn' to —been—.

Column 5, line 9, correct "Wherein" to —wherein—.

Column 7, line 32, correct "claim 1" to —claim 15—.

Signed and Sealed this

Fifteenth Day of January, 1991

*Attest:*

HARRY F. MANBECK, JR.

*Attesting Officer*

*Commissioner of Patents and Trademarks*